US005220691A

United States Patent [19]

Wiegers

[11] Patent Number: 5,220,691

[45] Date of Patent: Jun. 22, 1993

[54] KNEE PROTECTING DEVICE

[76] Inventor: David A. Wiegers, 3861 Hunters Creek Rd., Metamora, Mich. 48455

[21] Appl. No.: 836,605

[22] Filed: Feb. 18, 1992

Related U.S. Application Data

[63] Continuation-in-part of Ser. No. 762,378, Sep. 19, 1991, abandoned.

[51] Int. Cl.[5] ..... A41D 13/00

[52] U.S. Cl. ..... 2/24; 2/22; 2/23; 2/2; 2/2.5

[58] Field of Search ..... 2/24, 22, 23, 2, 2.5; 128/80 C, 80 F

[56] References Cited

U.S. PATENT DOCUMENTS

| | | | |
|---|---|---|---|
| D. 164,595 | 9/1951 | Owen, Jr. et al. | D7/7 |
| 1,081,245 | 12/1913 | McCall | 2/24 |
| 1,533,907 | 4/1925 | Whipp | 2/24 |
| 1,583,181 | 5/1926 | Rubio | 2/24 |
| 2,154,364 | 4/1939 | Snyder | 2/24 |
| 2,534,888 | 12/1950 | Vold | 2/24 |
| 2,561,872 | 7/1951 | Krinick | 2/23 |
| 3,259,910 | 7/1966 | Daignault | 2/24 |
| 3,965,486 | 6/1976 | Lightbody | 2/24 |
| 4,354,280 | 10/1982 | Hayes | 2/16 |
| 4,490,855 | 1/1985 | Figgie, III et al. | 2/24 |
| 4,561,123 | 12/1985 | Hull | 2/23 |
| 4,688,269 | 8/1987 | Maeshima | 2/2 |
| 4,751,748 | 6/1988 | Ekins | 2/24 |
| 4,999,847 | 3/1991 | Barcelo | 2/24 |

FOREIGN PATENT DOCUMENTS

| | | | |
|---|---|---|---|
| 1129430 | 5/1962 | Fed. Rep. of Germany | 2/24 |
| 3517824 | 11/1986 | Fed. Rep. of Germany | 2/24 |
| 504288 | 4/1939 | United Kingdom | 2/24 |
| 2215585 | 9/1989 | United Kingdom | 2/24 |

*Primary Examiner*—Clifford D. Crowder
*Assistant Examiner*—Gloria Hale
*Attorney, Agent, or Firm*—Jack M. Wiseman

[57] ABSTRACT

A knee protecting device for a carpet installer which engages the kicking pad of a carpet stretcher during the installation of carpets. The knee protecting device reduces trauma to the carpet installer while striking the kicking pad of the carpet installer. Toward this end, the knee protecting device includes a semi-rigid body member that has a shape conforming to the contour of the knee of the carpet installer and the thigh of the carpet installer immediately above the knee. A resilient layer is secured to the inner concave wall of the semi-rigid body member and has a shape conforming to the contour of the knee of the carpet installer and the thigh of the carpet installer immediately above the knee. Radially extending ribs are fixed to the convex outer wall of the semi-rigid body member in the region in which the knee protecting device engages the kicking pad of the carpet stretcher for improving the distribution of force to reduce the impact on the knee of the carpet installer while the knee protecting device engages the kicking pad of the carpet stretcher.

9 Claims, 3 Drawing Sheets

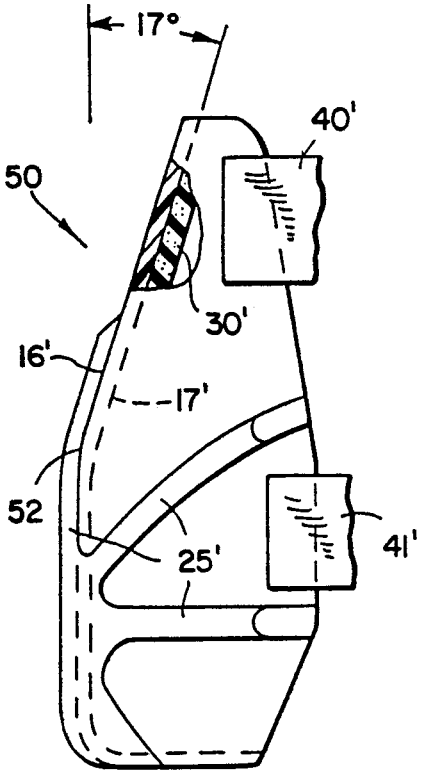
fig_7
fig_8
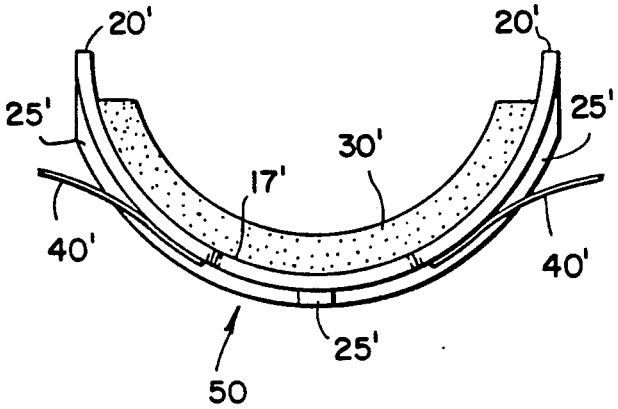
fig_9
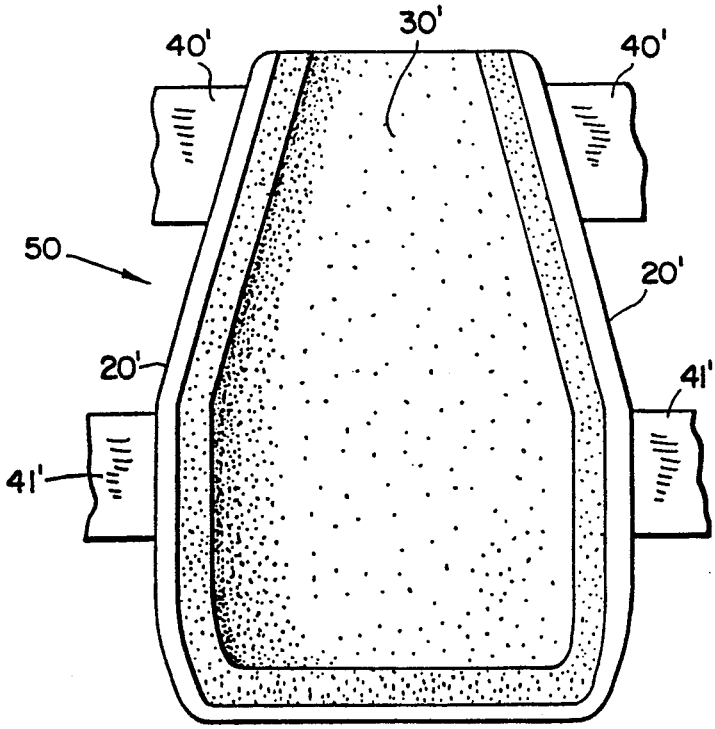

KNEE PROTECTING DEVICE

RELATED APPLICATION

This application is a continuation-in-part of my pending application, Ser. No. 07/762,378, filed on Sep. 19, 1991, for Knee Protection Device, now abandoned.

BACKGROUND OF THE INVENTION

The present invention relates in general to a device worn by a carpet installer during the installation of carpet. Specifically, the present invention relates to a knee protecting device which, when used by a carpet installer during the installation of carpets, protects the knee of the carpet installer from the shock generated by engaging the kicking pad of the carpet stretcher.

During the installation of carpet across a floor, the carpet installer stretches the carpet to eliminate wrinkles and then tacks the carpet to the floor to prevent displacement of the carpet. During the process of stretching the carpet, the carpet installer often uses a carpet stretcher or carpet kicker. Such a device grips the carpet to provide the installer with a means for applying a stretching force. Heretofore, the stretching force was applied by hitting the kicking or knee pad of the carpet stretcher with the installer's knee. Such impact on a knee had a traumatic effect on the carpet installer.

The U.S. Pat. No. to Hull, 4,561,123, issued on Dec. 31, 1985, for Knee-Pad Device, discloses a knee-pad device having a flexible, arcuate pad member attached above and below the knee. The device can be attached either to the legs of a pair of pants, or to a pair of straps which encircle a user's legs. The device protects the knees of the user while kneeling.

In the U.S. Pat. No. to Krinick, 2,561,872, issued on Jul. 24, 1951, for Knee Protector For Overalls And Other Garments, there is disclosed a knee cushioning and protective device that is attached to the knee portion of a garment. It protects the garment from wear when the wearer of the garment assumes a kneeling position.

In the U.S. Pat. No. to Vold, 2,534,888, issued on Dec. 19, 1950, for Knee Guard, there is disclosed a knee guard for protecting the knees of the wearer while kneeling. A cushioning pad is disposed in a pocket made of a single sheet of material.

The U.S. Pat. No. to Rubio, 1,583,181, issued on May 4, 1926, for Fulcrum Device For Earth Working Implements, discloses a device adapted to be attached to a leg of the wearer. The device provides a fulcrum upon which the handle shank of an earth working implement can be manually rocked to permit lifting of a quantity of earth with greater facility.

In the U.S. Pat. No. to Figgie III, et al., 4,490,855, issued on Jan. 1, 1985, for Knee Pad, there is disclosed a knee pad used as protective equipment while playing football. An upper pad is secured on the leg above the knee and a lower pad is secured on the leg below the knee. A cover holds portions of the upper and lower pads in overlapping relation at the front of the knee.

In the U.S. Pat. No. to Whipp, 1,533,907, issued on Apr. 14, 1925, for Knee Protector, there is disclosed knee protectors for protecting the wearer thereof while kneeling. The knee protector is provided with tension adjusting means and means for permitting the passage of air through the pads.

In the U.S. Pat. No. to Snyder, 2,154,364, issued on Apr. 11, 1939, for Knee Protector, there is disclosed a knee protector for persons playing marbles.

The U.S. Pat. No. to McCall, 1,081,245, issued on Dec. 9, 1913, for Knee Protector, discloses a knee protector for use by carpet layers. The knee protector is removably secured to the wearer. A pad is embodied in the knee protector to afford protection to the wearer while the wearer is kneeling.

In the U.S. Pat. No. to Hayes, 4,354,280, issued on Oct. 19, 1982, for Joint Protector, there is disclosed a knee protector for use by athletes. The knee protector comprises a unitary, relatively thick, foam-filled, semi-rigid, resilient molded plastic pad.

The U.S. design Pat. No. to Owen, Jr., D-164,595, issued on Sep. 18, 1951, for Tendon Protector Or Similar Device discloses a tendon protector that is attachable to a skate shoe.

In the U.S. Pat. No. to Daignault, 3,259,910, issued on Jul. 12, 1966, for Limb Protector For Hockey Players And The Like, there is disclosed a protector for an articulated joint, such as the knee or elbow. The protector includes a fiber or plastic plate sandwiched between foam-rubber layers. An outer covering for the protector is made of leather, plastic, or other flexible material.

In the U.S. Pat. No. to Maeshima, 4,688,269, issued on Aug. 25, 1987, for Protector For Sportswear, there is disclosed a protector for sportswear. The protector serves to protect a wearer's body at a location which tends to collide with an obstacle. The protector comprises a pad fixed to sportswear material by bonding or fusing. A hard cover plastic plate overlying the pad is fixed to the sportswear material.

The U.S. Pat. No. to Ekins, 4,751,748, issued on Jun. 21, 1988, for Shin Guards discloses a shell-like knee protector hinged to a shell-like shin protector. Ribs are formed on the shin protector. A foam pad underlies the knee protector. The shell-like knee protector and the shell-like shin protector are made of molded plastic material.

The U.S. Pat. No. to Barcelo, 4,999,847, issued on Mar. 19, 1991, for a Shin Guard comprises a knee protector pivotally mounted on a shin protector. The knee protector and the shin protector are strapped around the wearer.

SUMMARY OF THE INVENTION

A knee protecting device is worn by a carpet installer to engage the kicking pad of a carpet stretcher during the installation of carpets and the like. The knee protecting device comprises a semi-rigid body member having a greater length than width and is bowed widthwise. The semi-rigid body member has a concave inner surface configured to conform generally to the shape of a knee. A resilient layer is secured at one surface to the concave inner surface of the semi-rigid body member and has a configuration conforming to the shape of the concave inner surface of the semi-rigid body member. The resilient member has another surface oppositely directed with respect to the aforesaid one surface thereof for confronting the knee of a carpet installer.

An object of the present invention is to provide a knee protecting device worn by a carpet installer to engage the kicking pad of a carpet stretcher during the installation of carpets and the like.

A feature of the present invention is the provision of ribs projecting outwardly from the outer wall of a semi-rigid body member for improved distribution of the impact of the force, when the knee protecting device engages the kicking pad of a carpet stretcher, to reduce the trauma on the kicking knee of a carpet installer.

BRIEF DESCRIPTION OF THE DRAWINGS

FIG. 7 is a side elevation view of the knee protecting device shown in FIG. 6 partially broken away to illustrate a layer of resilient material.

FIG. 8 is an end elevation view of the knee protecting device shown in FIGS. 6 and 7.

FIG. 9 is a rear elevation view of the knee protecting device shown in FIGS. 6–8.

DETAIL DESCRIPTION OF THE INVENTION

Figure 1:
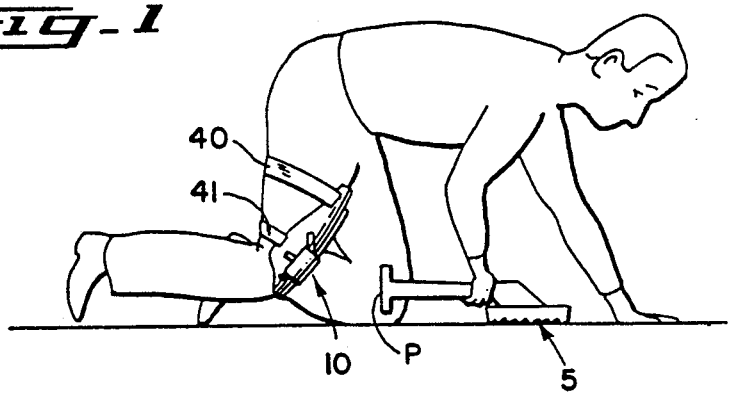
FIG. 1 is a diagrammatic side elevation view of a carpet installer employing a knee protecting device embodying the present invention to engage the kicking pad of a carpet stretcher.

Illustrated in FIG. 1 is a knee protecting device 10 embodying the present invention. In the course of installing carpets, the carpet is stretched to eliminate wrinkles and is subsequently tacked to a supporting surface to prevent displacement of the stretched carpet. A suitable and well-known carpet stretcher S is employed to stretch the carpet being installed. The carpet stretcher S comprises a kicking or knee pad P. A stretching force is applied to the carpet being installed by the carpet layer using his knee to strike the kicking pad P of the carpet stretcher S. In order to reduce the trauma on the knee of the carpet layer in hitting the kicking pad P of the carpet stretcher S, the knee protecting device 10 is worn by the carpet installer on the knee engaging the kicking pad P of the carpet stretcher S.

Figure 2:
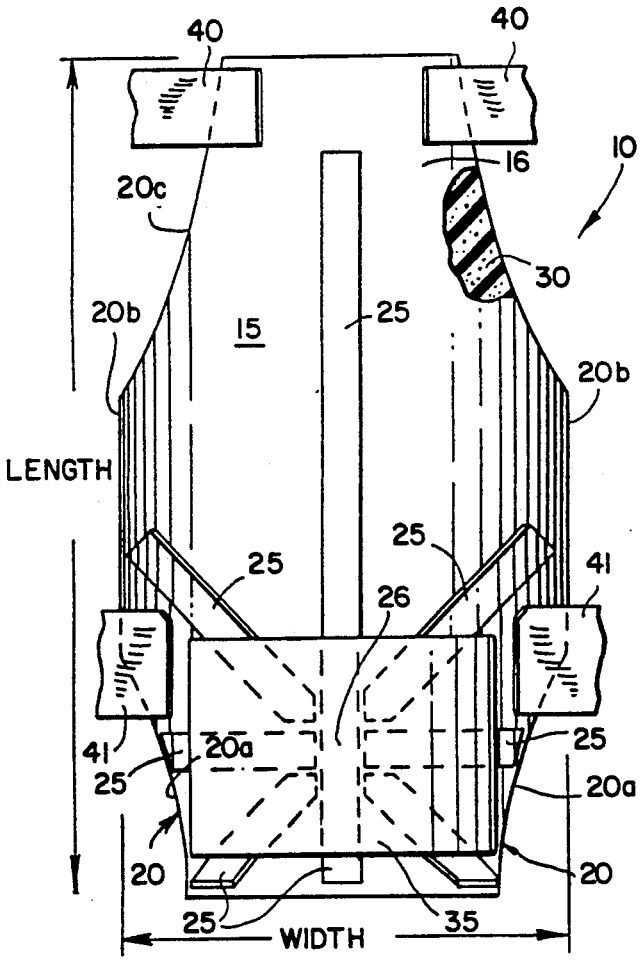
FIG. 2 is a plan view of a knee protecting device embodying the present invention partially broken away to illustrate a layer of resilient material.
Figure 3:
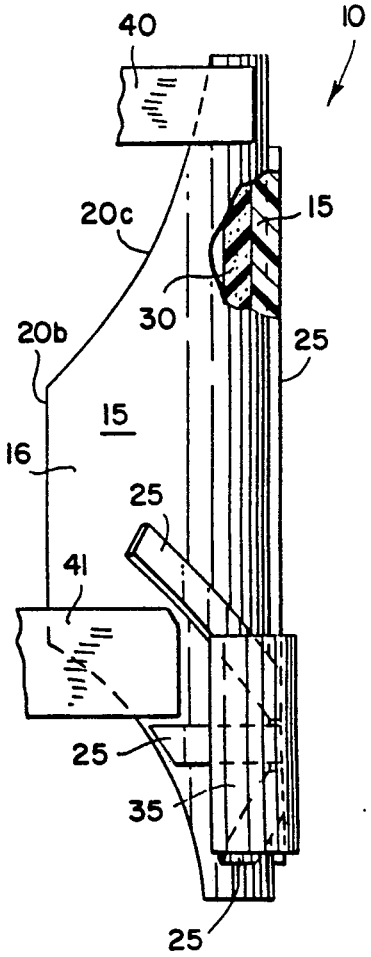
FIG. 3 is a side elevation view of the knee protecting device shown in FIG. 2 partially broken away to illustrate a layer of resilient material.
Figure 4:
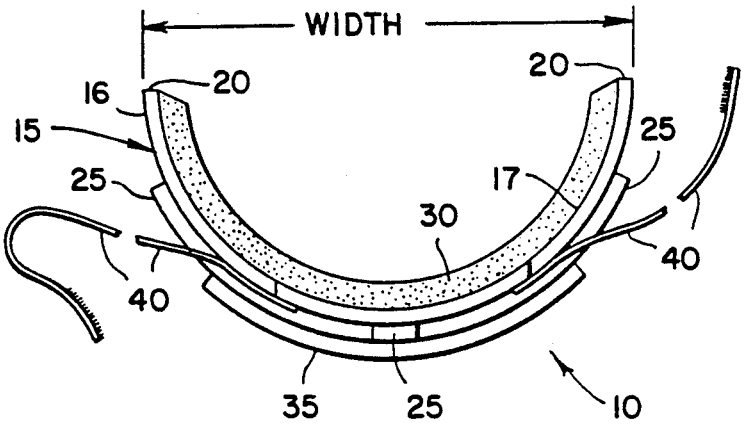
FIG. 4 is an end elevation view of the knee protecting device shown in FIGS. 2 and 3.

Referring to FIGS. 2–4, the knee protecting device 10 comprises a semi-rigid body member 15 having a greater length than a width and is bowed widthwise. The lengthwise dimension is viewed from top-to-bottom in FIGS. 2 and 3. The widthwise dimension is viewed diametrically from side-to-side in FIGS. 2 and 4. In the exemplary embodiment, the body member 15 is made of suitable semi-rigid material, such as plastics, or hardened polymers such as polyvinylchloride, polyethylene, polyurethane, nylon and the like. It is within the contemplation of the present invention, that the body member 15 may be made of a high impact plastic or fiberglass. The body member 15 may be molded by a suitable process, such as an injection molding process.

The body member 15 defines a generally convex outer surface 16 and a generally concave inner surface 17 (FIG. 4). In the preferred embodiment, the inner surface 17 is configured to conform generally to the contour of the anterior portion of the knee of the wearer and the anterior portion of the thigh of the wearer immediately above the knee. In the preferred embodiment, the concave inner surface 17 of the body member 15 is dimensioned to cover the anterior portion of the knee of the wearer and the anterior portion of the thigh of the wearer immediately above the knee.

As shown in FIG. 4, the body member 15, when viewed from the lower end thereof, has a generally semi-cylindrical configuration. Side walls 20 of the body member 15, when viewed from the lower end thereof (FIGS. 2 and 3), extend, respectively, gradually upwardly and outwardly over arcuate sections 20*a*. From the respective arcuate sections 20*a*, the side walls 20 continue along generally linear sections 20*b*. From the respective linear sections 20*b*, the side walls 20 are directed gradually inwardly and upwardly over arcuate sections 20*c*. The contour of the walls 20 at the arcuate sections 20*a* and 20*c* thereof enables the wearer to move about with greater facility. In the exemplary embodiment, the thickness of the body member 15 is in the range of ⅛ inch to ½ inch.

For improving the distribution of the impact of the force resulting from the knee protecting device 10 striking the pad P of the carpet stretcher S so as to reduce the trauma on the knee of the wearer, a plurality of generally radially directed ribs 25 (FIG. 2) are, in the preferred embodiment, integrally formed at the lower section of the outer front wall of the body member. In the exemplary embodiment, the ribs 25 are formed as a unitary part of the body member 15 so as to constitute a single piece therewith. The ribs 25 may be formed with the body member 15 by injection molding, or other suitable molding processes.

Each rib 25 is generally an elongated member with a relatively flat, outwardly directed surface generally conforming in curvature with the outer front surface of the body member 15. The inwardly directed ends of the ribs 25 converge toward a center point 26 on the outer front surface of the body member 15 (FIG. 3). The ribs 25, at their respective converging ends, may be spaced from the center point 26 or may be in contact with one another in the vicinity of the center point 26. The center point 26 is generally located at the intended center of impact between the knee protecting device 10 and the kicking pad P of the carpet stretcher S.

At least four ribs 25 may be employed. In the exemplary embodiment, eight ribs 25 are employed for improving the distribution of the impact of force resulting from the knee protecting device 10 striking the pad P of the carpet stretcher S. In the exemplary embodiment, the width of each of the ribs 25 is between ¼ inch and ½ inch. In the exemplary embodiment, the depth of the each of ribs 25 is between ⅛ inch and ¼ inch.

Secured to the inner concave wall 17 of the body member 15 is a layer 30 of resilient material (FIGS. 2–4). In the exemplary embodiment, the layer 30 of resilient material is made of urethane foam and is caused to adhere to the inner concave wall 17 of the body member 17 by a suitable adhesive, such as an epoxy resin. The layer 30 of resilient material, in the exemplary embodiment, extends generally along the entire inner concave wall 17 to overlay substantially the entire surface thereof. In the preferred embodiment, the layer 30 of resilient material has a configuration and contour similar to the configuration and contour of the inner concave wall 17 so as to receive the anterior portion of the knee of the wearer and the anterior portion of the thigh immediately above the knee of the wearer. In the exemplary embodiment, the thickness of layer 30 of urethane foam is approximately ½ inch. The layer 30 of resilient material not only absorbs the impact of the body member 15 striking the kicking pad P of the carpet stretcher S, but, also, provides a more comfortable contact wall for the wearer of the knee protecting device 10.

Optionally, a cover plate 35 (FIGS. 2–4) may be secured to the outer surface of the ribs 25 and arranged to overlie the center point 26 and portions of the ribs 25 converging toward the center point 26. The cover plate 35 is configured to conform to the contour of the ribs 26 to which it is secured and to conform to the contour of the outer wall 16 of the body member 15 over which it is disposed. The body member 15, the ribs 25 and the cover plate 35 in the exemplary embodiment, are made of similar semi-rigid material, which have been hereinabove described. The cover plate 35, in the exemplary embodiment, is integrally formed with the ribs 25. The body member 15, the ribs 25 and the cover plate 35 may be formed as a single piece or unitary structure by a conventional and well-known molding process, such as an injection molding process. The cover plate 35 serves to distribute the impact of force from the knee protecting device 10 striking the kicking pad P of the carpet stretcher S uniformly to the ribs 25.

Figure 5:
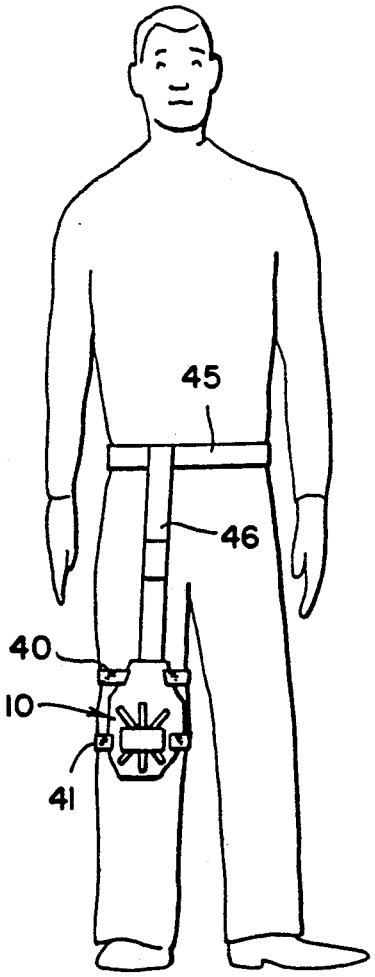
FIG. 5 is a diagrammatic front elevation view of a carpet installer having the knee protecting device embodying the present invention suspended from the waist of the carpet installer.
Figure 6:
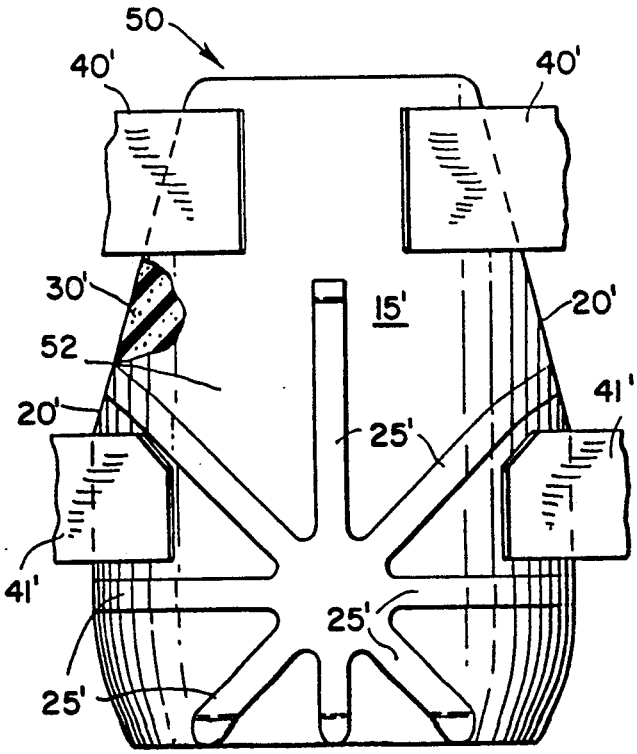
FIG. 6 is a front elevation view of a modified knee protecting device embodying the present invention partially broken away to illustrate a layer of resilient material.

For attaching the knee protecting device 10 to the leg of the carpet installer, suitable straps 40 and 41 (FIG. 1) are secured to body member 15 and wrapped around the upper portions of the knee and the portion of the thigh immediately above the upper portion of the knee. Preferably, there are two generally parallel straps 40 and 41. In the preferred embodiment, each strap 40 and 41 is detachably secured at separable confronting distal sections by separable interengaging hook and loop fastening means, such as VELCRO fasteners. The proximal ends of the straps 40 and 41 may be caused to adhere to the body member 15 by a suitable adhesive, such as an epoxy resin. If desired, the knee protecting device 10 may be suspended from a belt 45 about the waist of a carpet installer by an adjustable strap 46 secured to the upper section of the body member 15 of the knee protecting device 10 (FIG. 5).

Illustrated in FIGS. 6–9 is a knee protecting device 50 embodying the present invention, which is a modification of the knee protecting device 10, shown in FIGS. 1–5. Parts of the knee protecting device 50 similar to parts of the knee protecting device 10 will be shown with the same reference numeral and with a prime suffix.

Essentially, the knee protecting device 50 differs from the knee protecting device 10 in that the semi-rigid body member 15' and the resilient layer 30' at the upper section 51 thereof are angled inwardly approximately 17° from section 52 of the convex wall 16' and the concave wall 17' of the semi-rigid body member 15' bordered by the linear sections **20*b*' of the side walls 20' for receiving the upper anterior portion of the knee of the wearer and the anterior portion of the thigh of the wearer immediately above the upper portion of the knee (FIG. 7). This configuration of the body member 15' and the resilient layer 30' serves to make the knee protection device 50 more comfortable to the wearer. The ribs 25' overlying the upper section 51 of the body member 15' will conform to the contour of the upper section 51**.

What is claimed is:

1. A knee protecting device for use by a carpet installer to engage the kicking pad of a carpet stretcher during the installation of carpets and the like, said knee protecting device comprising:

(a) a semi-rigid body member having a greater length than width, said semi-rigid body member being bowed widthwise and having a concave inner surface configured to conform generally to the shape of a knee;

(b) a resilient layer having one surface secured to said concave inner surface of said semi-rigid body member, said resilient layer at said one surface thereof having a configuration conforming to the shape of said concave inner surface of said semi-rigid body member, said resilient layer having another surface oppositely directed with respect to said one surface thereof for confronting a knee of the carpet installer; and (c) fastening means secured to said semi-rigid body member for attaching the knee protecting device to the carpet installer so that said other surface of said resilient layer confronts the knee of the carpet installer, (d) said semi-rigid body member having a convex outer surface, said knee protecting device comprising a plurality of ribs disposed on said convex outer surface and extending from said convex outer surface for engaging the kicking pad of the carpet stretcher, said ribs being disposed angular distances apart along said convex outer surface of said semi-rigid body member.

2. A knee protecting device as claimed in claim 1 wherein said ribs at one end thereof converge centrally along said convex outer surface and at the other end thereof project in a radially outward direction.

3. A knee protecting device as claimed in claim 2 wherein said ribs are respectively configured to conform to the contour of said convex surface of said semi-rigid body member in the radial direction of said ribs.

4. A knee protecting device as claimed in claim 3 wherein said other surface of said resilient layer has a configuration conforming generally to the shape of the concave inner surface of said semi-rigid body member.

5. A knee protecting device as claimed in claim 4 wherein said convex inner surface of said semi-rigid body member and said other surface of said resilient layer are configured to conform generally to the anterior portion of the knee of a carpet installer and the anterior portion of the thigh of a carpet installer immediately above the knee of a carpet installer.

6. A knee protecting device as claimed in claim 5 wherein said semi-rigid body member includes a side wall along each side thereof, each of said side walls having a lower section and an upper section, each of said side walls has a downwardly and inwardly declining wall at the lower section thereof and an upwardly and inwardly inclining wall at the upper section thereof to facilitate movement by a carpet installer.

7. A knee protecting device for use by a carpet installer to engage the kicking pad of a carpet stretcher during the installation of carpets and the like, said knee protecting device comprising:

(a) a semi-rigid body member having a greater length than width, said semi-rigid body member being bowed widthwise and having a concave inner surface configured to conform generally to the shape of a knee;

(b) a resilient layer having one surface secured to said concave inner surface of said semi-rigid body member, said resilient layer at said one surface thereof having a configuration conforming to the shape of said concave inner surface of said semi-rigid body member, said resilient layer having another surface oppositely directed with respect to said one surface thereof for confronting a knee of the carpet installer; and (c) fastening means secured to said semi-rigid body member for attaching the knee protecting device to the carpet installer so that said other surface of said resilient layer confronts the knee of the carpet installer, (d) said other surface of said resilient layer having a configuration conforming generally to the shape of the concave inner surface of said semi-rigid body member, (e) said concave inner surface of said semi-rigid body member and said other surface of said resilient layer being configured to conform generally to the anterior portion of the knee of the carpet installer and to the anterior portion of the thigh of the carpet installer immediately above the knee of the carpet; and (f) said semi-rigid body member including a side wall along each side thereof, each of said side walls having a lower section and an upper section, each of said side walls having a downwardly and inwardly declining wall at the lower section thereof and an upwardly and inwardly inclining wall at the upper section thereof to facilitate movement by a carpet installer.

8. A knee protecting device as claimed in claim 7 wherein said inclining walls and said declining walls have arcuate configurations.

9. A knee protecting device for use by a carpet installer to engage the kicking pad of a carpet stretcher during the installation of carpets and the like, said knee protecting device comprising:

(a) a semi-rigid body member having a greater length than width, said semi-rigid body member being bowed widthwise and having a concave inner surface configured to conform generally to the shape of a knee;

(b) a resilient layer having one surface secured to said concave inner surface of said semi-rigid body member, said resilient layer at said one surface thereof having a configuration conforming to the shape of said concave inner surface of said semi-rigid body member, said resilient layer having another surface oppositely directed with respect to said one surface thereof for confronting a knee of the carpet installer; and (c) fastening means secured to said semi-rigid body member for attaching the knee protecting device to the carpet installer so that said other surface of said resilient layer confronts the knee of the carpet installer, (d) said semi-rigid body member having a convex outer surface, said knee protecting device comprising a plurality of ribs on the convex outer surface of said semi-rigid body member and extending along said convex outer surface for engaging the kicking pad of the carpet stretcher, said ribs being disposed angular distances apart along said convex outer surface of said semi-rigid body member, said ribs at one end thereof converge centrally along said convex outer surface and at the other end thereof project in a radially outward direction, said ribs being respectively configured to conform to the contour of said convex surface of said semi-rigid body member in the radial direction of said ribs, (e) said other surface of said resilient layer having a configuration conforming generally to the shape of the concave inner surface of said semi-rigid body member, said concave inner surface of said semi-rigid body member and said other surface of said resilient layer are configured to conform generally to the anterior portion of the knee of a carpet installer and the anterior portion of the thigh of a carpet installer immediately above the knee of a carpet installer, (f) said semi-rigid body member including a side wall along each side thereof, each of said side walls having a downwardly and inwardly declining wall at the lower section thereof and an upwardly and inwardly inclining wall at the upper section thereof to facilitate movement by a carpet installer, said inclining walls and said declining walls having arcuate configurations.

* * * * *